United States Patent [19]

Orsinger et al.

[11] 4,318,265

[45] Mar. 9, 1982

[54] ENVELOPE FLAP OPENER

[75] Inventors: Winston A. Orsinger, Nazareth; George Fallos, Easton, both of Pa.

[73] Assignee: Bell & Howell Company, Chicago, Ill.

[21] Appl. No.: 119,917

[22] Filed: Feb. 8, 1980

[51] Int. Cl.[3] ..... B31B 1/56; B65B 43/39

[52] U.S. Cl. ..... 53/492; 53/67; 53/382; 53/386; 493/245

[58] Field of Search ..... 53/492, 386, 382, 381 R, 53/384, 266 A, 569, 57, 505, 506, 67; 493/245, 317, 316, 418, 422, 9, 27, 8

[56] References Cited

U.S. PATENT DOCUMENTS

| | | | |
|---|---|---|---|
| 1,086,391 | 2/1914 | Molyneux | 53/386 X |
| 1,633,350 | 6/1927 | Russ | 53/381 R X |
| 3,253,384 | 5/1966 | Huck et al. | 53/53 |
| 3,583,124 | 6/1971 | Morrison | 53/381 R X |
| 3,974,749 | 8/1976 | Luperti et al. | 53/382 X |
| 3,996,727 | 12/1976 | Irvine et al. | 53/381 R |
| 4,079,576 | 3/1978 | Morrison et al. | 53/266 A |
| 4,086,746 | 5/1978 | Christy | 53/386 X |

*Primary Examiner*—James F. Coan

*Attorney, Agent, or Firm*—Griffin, Branigan & Butler

[57] ABSTRACT

An envelope flap opening apparatus 11 includes a suction cup 21 mounted on a slidable rotatable shaft 23. The shaft 23 both rotates the suction cup 21 so as to partially open an envelope flap 17 engaged thereby and advances the suction cup 21 alongside the travelling envelope 15 until the partially opened flap 17 passes beneath a stationary blade member 91 which fully opens the envelope flap 17.

10 Claims, 4 Drawing Figures

ENVELOPE FLAP OPENER

BACKGROUND OF THE INVENTION

This invention relates to the automatic and rapid insertion of letters and other material into envelopes prior to closure and mailing. High throughput insertion machines of this type are exemplified in U.S. Pat. No. 2,325,455 to A. H. Williams. More particularly, the invention concerns an apparatus and method for opening envelope flaps by the use of a rotatable suction cup.

U.S. Pat. No. 3,583,124 to Morrison and assigned to the assignee herein discloses an envelope flap opening apparatus employing a suction cup mounted on a rotatable shaft and positioned alongside an envelope conveying means. After the suction cup makes contact with an envelope flap travelling on the conveying means, a vacuum is applied to the suction cup. The suction cup then engages the envelope flap and rotates about the axis of the rotatable shaft away from the plane of the conveying means, thereby partially opening the flap. A blade member assembly rotates in the direction of the flap until a vertical head portion of a blade member contacts the leading edge of the partially opened flap. The blade member then forces the flap to a fully opened position. While the envelope flap is open, the envelope is rapidly passed toward an insertion plate where letters or other material are automatically inserted. The blade member then rotates back into its original position in preparation for the next envelope.

The envelope flap opening apparatus described above requires that the conveying means and the envelope transported thereon be stopped for a dwell period in the machine cycle. In this particular prior art apparatus the dwell period is necessary to permit the suction cup to engage the envelope flap; to rotate the suction cup and the envelope flap adhering thereto away from the plane of the conveying means; and, to force the flap into a fully opened position. Unfortunately, the dwell period increases production time and lowers output efficiency.

Therefore, an object of this invention is the provision of an efficient envelope flap opening apparatus which reduces the dwell period previously associated with the operation of a rotatable suction cup and a rotatable blade member.

An advantage of the invention is the capability to employ a fixed blade member less susceptible to mechanical complications. Additionally, fixed blade members of different sizes may be easily and advantageously substituted for the blade member installed on the machine. This adapts the envelope flap opening machine to a variety of sizes and shapes of envelopes.

SUMMARY OF THE INVENTION

In the present envelope flap opening apparatus a suction cup engages an envelope flap travelling on a conveying means. While the envelope is traveling on the conveying means, the suction cup rotates away from the plane of the conveying means in order to partially open the flap. The suction cup travels with the envelope so that the partially opened flap may pass beneath a stationary blade member which fully opens the envelope flap.

The advancement of the suction cup alongside the travelling envelope is facilitated by a pull cable ultimately connected to a machine drive shaft rotating in timed relation with both the movement of the envelope along the conveying means and the operation of a vacuum means. As the pull cable advances the suction cup and a system of gears integral therewith, a cam roller follower connected to a periphery of a gear moves along a cam surface to rotate the gears, the rotatable shaft, and the suction cup. After the envelope flap has been opened a spring returns the suction cup and its rotating mechanisms to a start position in contact with a new unopened envelope flap.

BRIEF DESCRIPTION OF THE DRAWINGS

The invention will be more readily understood by reference to the accompanying drawings.

DESCRIPTION OF THE PREFERRED EMBODIMENT

Figures 1, 2, 3, 4:
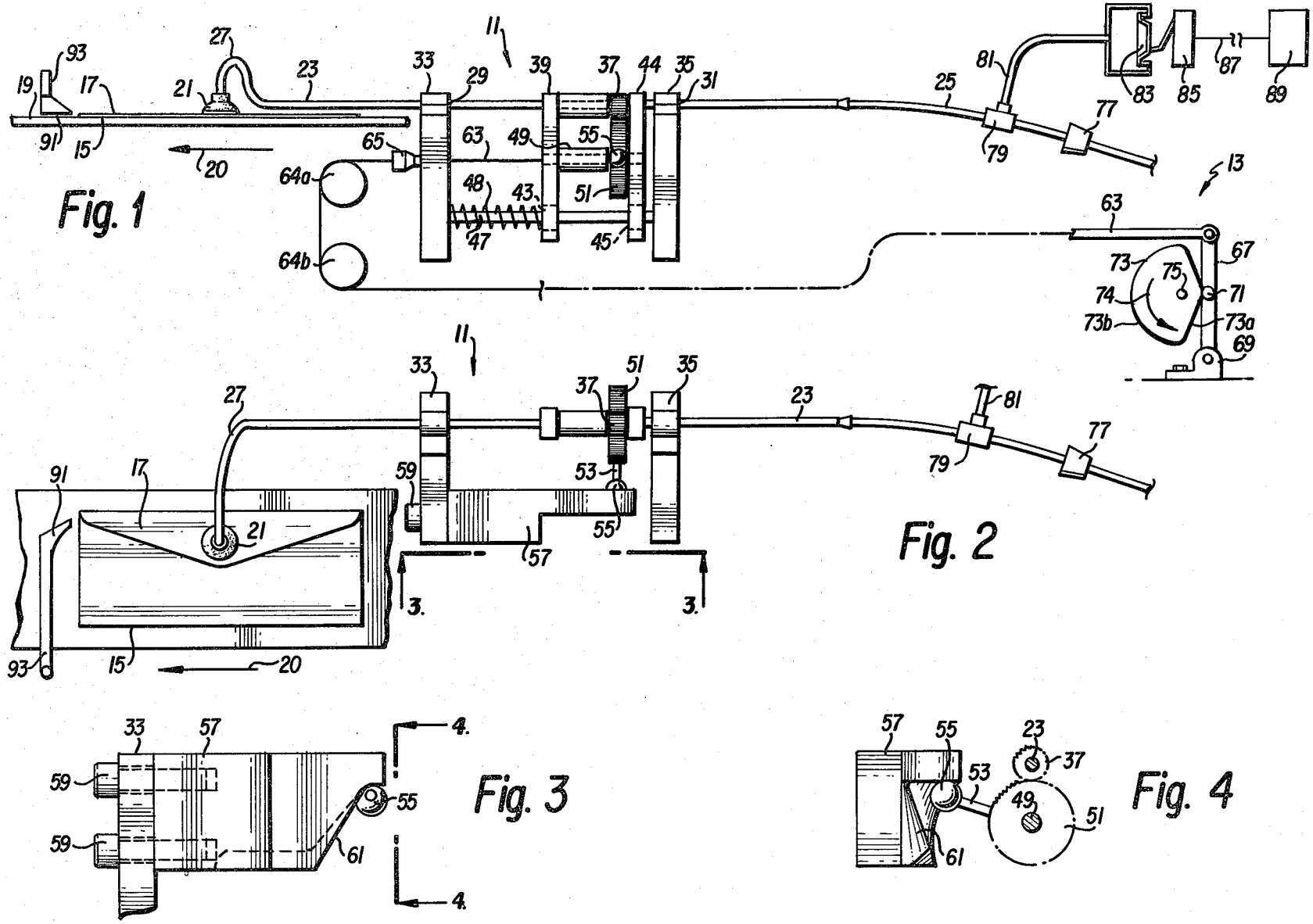
FIG. 1 is a fragmentary side elevation of the flap opening apparatus with most of the supporting structure broken away.
FIG. 2 is a fragmentary plan view of the flap opening apparatus.
FIG. 3 is a transverse cross-sectional view taken along line 3—3.
FIG. 4 is a transverse cross-sectional view taken along line 4—4.

The envelope flap opening apparatus 11 and its plate-cam mechanism 13 perform the function of opening flaps on envelopes preparatory to having articles inserted into the envelopes in an automatic mail inserting machine. Referring to FIG. 1, an envelope 15 with its closed flap 17 is moved along a conveyor 19 in the direction of arrow 20 to a position beneath a suction member, such as sucker cup 21.

The sucker cup 21 is connected to a rotatable shaft 23 which, in one embodiment, is a hollow, rigid vacuum tube 23 connected to a source of vacuum (not shown) through a flexible vacuum line 25. The rigid vacuum tube 23 is straight along most of its axial length except for an arcuate curved section 27 near the sucker cup 21.

The rigid vacuum tube 23 is supported by slip joints 29 and 31 in brackets 33 and 35 respectively. The brackets 33 and 35 are secured to the main supporting structure of the machine, preferably under a table top (not shown). The rigid vacuum tube 23 and a gear 37 circumferentially attached thereto are carried by sliding guide supports 39 and 41 which slide on bearings 43 and 45 along a rod 47. The ends of the rod 47 are mounted to the two support brackets 33 and 35. A compression spring 48 surrounding the rod 47 is compressed between the bracket 33 and the sliding guide support 39.

The rigid vacuum tube 23 is rotatably mounted in the sliding guide supports 39 and 41. A shaft 49 secured between the sliding guide supports 39 and 41 carries a large gear 51 which meshes with the gear 37 attached to the periphery of the rigid vacuum tube 23.

With reference to FIGS. 2 and 4, a cam follower shaft 53 and its cam follower roller 55 are attached to the periphery of the large gear 51. A stationary cylindrical cam 57 is secured by threaded bolts 59 to the support bracket 33. As can be seen in FIGS. 3 and 4, the stationary cylindrical cam 57 has a three-dimensional cam surface 61 upon which the cam follower roller 55 rides.

Referring back to FIG. 1, one end of a pull cable 63 passes through a slip joint 65 in support bracket 33 and is attached to the sliding guide support 39. The cable 63 is directed by two pulleys **64*a* and 64*b* to the plate-cam mechanism 13 where the cable 63 is attached to a cam follower arm 67. The cam follower arm 67** is pivotably mounted to a bracket 69 which is secured by a bolt to supporting structure of the machine.

A roller cam follower 71 is mounted on the cam follower arm 67 at a position between the bracket 69 and the cable 63 and is maintained in contact with a plate cam 73. The plate cam 73 has a low surface 73*a* and a circular, high surface 73*b*. The plate cam 73 is secured to a drive shaft 75. Drive shaft 75 is driven by the main drive train mechanism (not shown) in coordination both with a suction valve 77 mounted in the flexible vacuum line 25 and with the conveyor 19.

A "T" fitting 79 installed in the flexible suction line 25 is connected by a line 81 by a sealed diaphragm unit 83. A micro switch 85 is mounted in contact with the diaphragm of the sealed unit 83 and is electrically connected by wire 87 to a control unit 89.

A stationary blade assembly, such as plow 91, is mounted by a bracket 93 alongside the conveyor 19 in position to contact the flap 17 of an envelope 15 as it is partially opened by the sucker cup 21.

In operation, an envelope 15 is advanced along the conveyor 19 to the envelope flap opening apparatus 11 in the manner of the Morrison 3,583,124 patent cited above and incorporated herein by reference. When the envelope 15 is alongside the sucker cup 21, the sucker cup 21 is lowered onto the flap 17 of the envelope 15. Suction valve 77 opens to cause a vacuum in the flexible vacuum line 25, the rigid vacuum tube 23, and the sucker cup 21. This vacuum sucks the flap 17 onto the sucker cup 21.

The drive shaft 75 rotates the plate cam 73 in the counterclockwise direction indicated by arrow 74. When cam 73 rotates so that its high surface 73*b* is bearing against the roller cam follower 71, cam follower arm 67 pivots to the right, thereby pulling cable 63 and sliding guide support 39. As a result, both supports 39 and 41 move to the left which, in turn, moves the rigid vacuum tube 23 and its sucker cup 21 alongside the conveyor 19 at the same rate of speed as the envelope 15.

As the sliding guide supports 39 and 41 are moved to the left, the cam follower roller 55 maintains contact with the three-dimensional cam surface 61 of the stationary cam 57. As seen in FIG. 3, due to the shape of cam surface 61, leftward motion of the roller 55 also forces roller 55 downwardly, thus causing the large follower gear 51 to rotate on its shaft 49 in the counterclockwise direction. As illustrated in FIG. 4, this in turn causes the vacuum tube gear 37 and the rigid vacuum tube 23 to which it is attached to rotate in the clockwise direction, thus raising the arcuate curved section 27, the sucker cup 21, and the envelope flap 17 sucked thereon while all move leftward.

After the envelope flap 17 has been partially opened in this manner, and as the sucker cup 21 continues to travel leftward with the flap 17 engaged thereto, the envelope flap 17 encounters the plow 91 positioned alongside conveyor 19. The plow 91 extends over the crease of the envelope flap 17 to fully open and hold open the envelope flap, even after suction has been terminated as described hereinafter.

In the above respect, the plow 91 is stationary as opposed to being rotatably mounted alongside the conveyor 19 in the manner depicted in the aforementioned Morrison patent. Various sized blade members may be selectively interchanged in order to open flaps on envelopes of differing sizes.

After the flap 17 has encountered the plow 91, the sliding guide support 39 reaches the extreme limit of its travel near support bracket 33. At this time, suction valve 77 closes and terminates the vacuum applied to the sucker cup 21. Although envelope flap 17 is now released from sucker cup 21, the flap 17 remains raised to its fully opened position from the envelope 15 due to the effect of the plow 91. After insertion is made into the fully open envelope 15, envelope 15 with its opened flap 17 is moved continuously by the conveyor 19 to its next position in the automatic mail inserting machine.

After the apparatus has opened a flap in the aforedescribed manner, the plate cam 73 of FIG. 1 rotates from its high surface 73*b* to its low surface 73*a* so that the low surface is 73*a* in contact with the roller cam follower 71. The cam follower arm 67 pivots to the left, releasing the tension on the cable 63. The compression spring 48 is then able to push the sliding guide supports 39 and 41 back toward their extreme right position so that the sliding guide support 41 bears against support bracket 35. As the sliding guide supports 39 and 41 move to the right in FIGS. 3 and 4, the cam follower roller 55 rides to the right and upwardly on the three-dimensional cam surface 61, causing the large follower gear 51 to rotate in a clockwise direction on its axis 49. Rotation of gear 51 causes the vacuum tube gear 37 and the rigid vacuum tube 23 to rotate in a counterclockwise direction to return the sucker cup 21 down to the conveyor 19 to the position illustrated in FIG. 1 for contact with the flap of the next envelope being advanced along the conveyor 19.

The suction in the suction line 25 is maintained constant during that portion of a machine cycle when the sucker cup 21 is in contact with an envelope flap 17. If an envelope is not present during that portion of the machine cycle, or if an envelope is missing a flap, the suction in the suction line 25 drops and causes the diaphragm 83 to activate the microswitch 85. When activated, microswitch 85 transmits a signal to the control unit 89 to either shut down the automatic mail inserting machine or to activate an alarm.

While the invention has been particularly shown and described with reference to preferred embodiments thereof, it will be understood by those skilled in the art that various alterations in form and detail may be made therein without departing from the spirit and scope of the invention. For example, instead of using the cable 63 as illustrated, a push/pull cable may employed to connect the plate-cam mechanism 13 to the sliding guide supports.

The embodiments of the invention in which an exclusive property or privilege is claimed are defined as follows:

We claim:

1. An envelope flap opening apparatus in a machine having means for conveying an envelope having a closed flap comprising:

a suction member mounted on a rotatable shaft and adapted to rotate about the axis of said shaft;

a fixed blade member positioned adjacent to said suction member along said conveying means;

means for rotating said shaft so that said suction member mounted on said shaft engages the envelope flap and lifts said flap to a partially open position;

means for applying a vacuum to said suction member as it engages said flat; and, means for advancing said suction member and said rotatable shaft alongside said envelope so that the partially opened flap thereof passes beneath said fixed blade member as said envelope moves along said conveying means, thereby permitting said blade member to extend over a crease of the envelope flap and to fully open and hold said flap in an open position.

2. An envelope flap opening apparatus as defined in claim 1 wherein said advancing means further comprises:

at least one support member integral with said rotatable shaft and adapted for sliding movement in a direction parallel to the axis of said shaft;

a machine drive shaft rotating in timed relationship with the movement of an envelope on said conveying means and with the operation of said means for applying a vacuum, said machine drive shaft having mounted thereto a cam;

a cam follower moving in response to said cam on said machine drive shaft; and, a cable connected to said cam follower and to said support member for pulling said support member in a first direction along said axis as said cam follower moves in response to the rotation of said machine drive shaft.

3. An envelope flap opening apparatus as defined in claim 2 wherein said support member integral with said rotatable shaft is biased in a second direction along said axis by a compression member.

4. An envelope flap opening apparatus as defined in claim 1 wherein said means for rotating said shaft further comprises:

a first gear rigidly attached to said rotatable shaft;

a second gear adapted to mesh with said first gear, said second gear having a cam roller follower connected to its periphery, said second gear also being integral with means for advancing said suction member; and, a cam surface rigidly mounted to said machine, said cam surface adapted to cause said first and second gears to rotate as said means for advancing moves said cam roller follower on said second gear along said cam surface, the rotation of said first gear causing said rotatable shaft to rotate about its axis.

5. An envelope flap opening apparatus as defined in claim 1 wherein said rotatable shaft is slidable axially and is a hollow shaft in fluid communication with said vacuum.

6. An envelope flap opening apparatus as defined in claim 1 wherein the configuration of said blade member is adapted to accomodate different sizes of envelopes.

7. An envelope flap opening apparatus as defined in claim 1 including means for detecting the absence of an envelope flap in position for opening.

8. An envelope flap opening apparatus as defined in claim 7 wherein said detecting means gauges the relative strength of suction created through said suction member.

9. A method for opening an envelope flap comprising:

transporting an envelope having a closed flap along a conveying means;

contacting said closed flap of said envelope with a suction member mounted on a rotatable hollow shaft by rotating said shaft until said suction member contacts said flap;

applying a vacuum to said suction member sufficient to cause the engagement of said flap and said suction member;

rotating said hollow shaft to partially open said flap;

advancing said suction member alongside said envelope so that the partially opened flap thereof passes beneath a fixed blade member until said fixed blade member moves said flap into a fully open position; and, releasing the vacuum on said suction member as said blade member contacts said flap.

10. The method of claim 9 including the steps of configuring said blade member to accomodate the size and shape of given envelopes; and, using the resulting configuration to open the respective flaps of said given envelopes.

* * * * *